US005664704A

United States Patent [19]

Meadows et al.

[11] Patent Number: 5,664,704

[45] Date of Patent: Sep. 9, 1997

[54] DROPWISE LIQUID DISPENSING SYSTEM PARTICULARLY SUITABLE FOR LIQUIDS HAVING LOW SURFACE TENSION

[75] Inventors: David L. Meadows, Mission Viejo; Katherine C. Kurjan, Huntington Beach; Larry E. Branham, San Juan Capistrano, all of Calif.

[73] Assignee: Allergan, Inc., Irvine, Calif.

[21] Appl. No.: 534,288

[22] Filed: Nov. 13, 1995

Related U.S. Application Data

[62] Division of Ser. No. 238,462, May 5, 1994, Pat. No. 5,497,910.

[51] Int. Cl.[6] ..... B65D 37/00

[52] U.S. Cl. ..... 222/209; 222/95; 222/420

[58] Field of Search ..... 222/131, 95, 209, 222/420, 494, 94

[56] References Cited

U.S. PATENT DOCUMENTS

| | | | |
|---|---|---|---|
| 4,047,642 | 9/1977 | Nilson | 222/131 X |
| 4,098,434 | 7/1978 | Uhlig | 222/94 |
| 4,909,416 | 3/1990 | Evezich | 222/209 X |
| 5,497,910 | 3/1996 | Meadows et al. | 222/420 X |
| 5,505,342 | 4/1996 | Okamura et al. | 222/131 X |
| 5,529,213 | 6/1996 | Mack et al. | 222/95 |

*Primary Examiner*—Gregory L. Huson
*Attorney, Agent, or Firm*—Walter A. Hackler

[57] ABSTRACT

A dropwise liquid dispensing system is provided which includes a liquid formulation having a surface tension of less than a specific value. A tip is provided for dispensing of the liquid formulation in a dropwise fashion and an inner bottle, in communication with the tip, contains the liquid formulation, and forces the liquid formulation through the tip when compressed. The inner bottle is configured with a volume for preventing a liquid formulation from flowing out of the bottle through the tip without compression of the inner bottle. An outer bottle is provided and disposed around the inner bottle for compressing the inner bottle. The inner and outer bottles are sized for providing hydraulic advantage in compressing the inner bottle with the hydraulic advantage being manifested by the outer bottle having a greater inner surface area than an outer surface of the inner bottle.

7 Claims, 2 Drawing Sheets

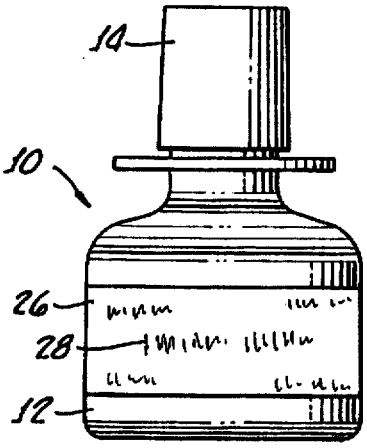
FIG. 1.
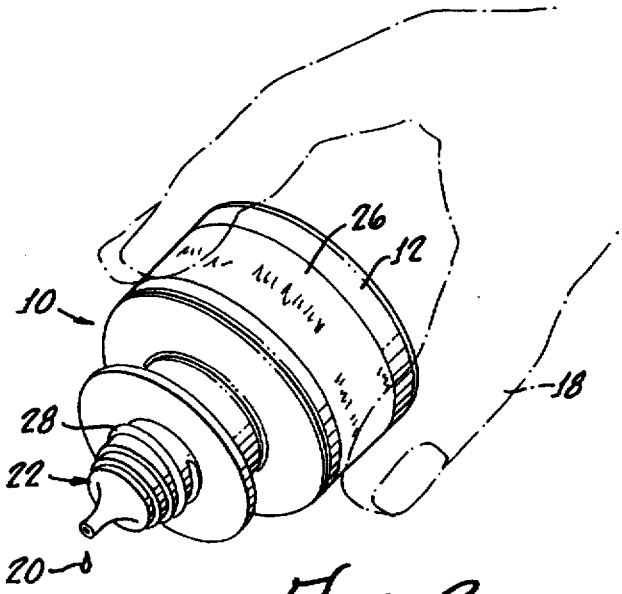
FIG. 2.
FIG. 3.
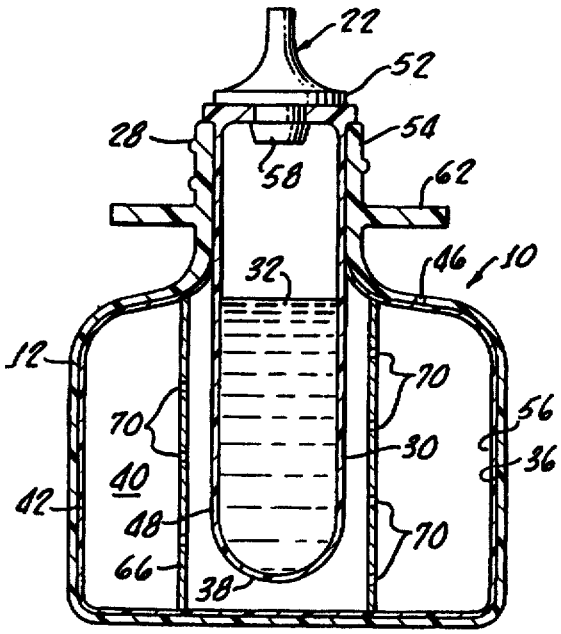
FIG. 4.
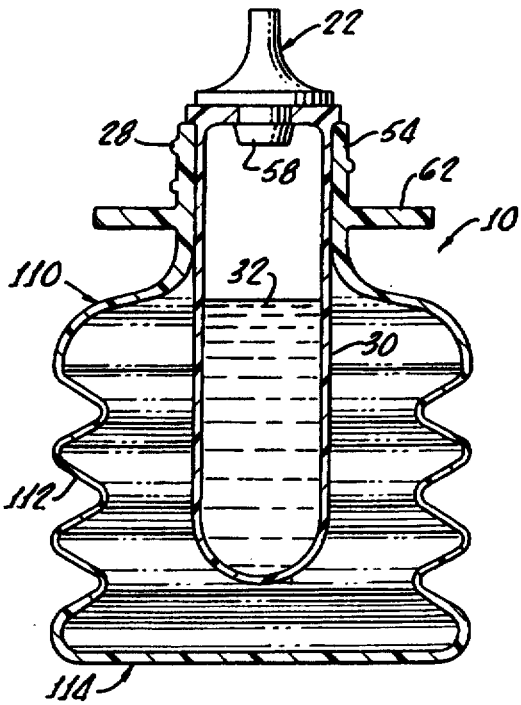

DROPWISE LIQUID DISPENSING SYSTEM PARTICULARLY SUITABLE FOR LIQUIDS HAVING LOW SURFACE TENSION

This application is a division of application Ser. No. 08/238,462, filed May 5, 1994 now U.S. Pat. No. 5,497,910.

The present invention generally relates to the dropwise dispensing of liquid formulations and is most particularly directed to dispensers for dispensing of liquids having low surface tension, as may be the case with specific beneficial agents, particularly in a wide variety of ophthalmic applications. Surface tension is one of the most important factors in the formation of a droplet dispensed from a container through an opening capable of forming individual droplets.

It is well-known that the surface of any liquid behaves like an elastic sheet, thereby pulling a drop of liquid into the shape of the smallest possible surface area. Under weightless conditions, the liquid droplet forms a sphere. This surface tension effect results from the fact that, whereas molecules of liquid within the drop are attracted equally in all directions by the molecules, a molecule at the surface experiences only an inward force from the other molecules.

Since the outward attractive forces from the molecules of air or vapor outside the drop are much less strong, the layer of molecules comprising the surface behaves like an elastic skin.

In this regard, the surface tension acts to contract the surface area of a liquid and it can be measured as a force acting at right angles to a line of unit length on the surface. For example, for water the force is about 72 dynes for a line of 1 cm in length, or about 0.07 ounce weight per foot.

A contained liquid, for example, an ophthalmic formulation disposed within a dispensing bottle, has contact with the solid interior surfaces of the bottle. The attractive forces between the molecule of a solid and those of a liquid may be stronger than those between the liquid molecules. This is particularly true for liquids having low surface tension.

The attractive force between the molecules of the liquid formulation and the container walls is known as adhesive tension, which causes the surface of the formulation to be pulled up where it is in contact with the surface to form a meniscus.

Liquids having a low surface tension therefore have a lower attractive force to the interior walls of a container. Therefore, during the initial stage of dispensing, the weight of the fluid tends to cause the fluid to stream through the nozzle without forming desired drops until a vacuum forms within the dispenser and adhesive forces on the remaining liquid enable desirable dropwise dispensing.

In other words, a large capacity dispensing bottle and nozzle arrangement will not permit dropwise dispensing of liquid therefrom without streaming when the liquid being dispensed has a surface tension below a critical point.

To overcome this problem one typically utilizes bottles of smaller capacity. However, in some instances, it is not practical to utilize small bottles because they are difficult to handle and manipulate, i.e., squeeze, in order to dispense the formulation.

In addition to the difficulty in handling small bottles or vials of formulations is the difficulty in properly marking the bottles with both instructions for use or contents and other labeling requiring by regulatory agencies.

SUMMARY OF THE INVENTION

A dropwise liquid dispensing system in accordance with the present invention generally includes a liquid formulation having a surface tension of less than a specific value, such as, for example, 25 dynes/cm. Optical formulations particularly suited for the present invention include perfluorodecalin formulations which have surface tensions of about 19.3 dynes/cm at 25° C.

A tip provides means for dispensing the liquid formulation in a dropwise fashion and an inner bottle means, in fluid communication with the tip, is provided for both containing the liquid formulation and for forcing the liquid formulation through the tip means upon compression of the inner bottle means.

In accordance with the present invention, a volume of the inner bottle provides a means for preventing the liquid formulation from flowing out of the inner bottle means through the tip means without compression of the inner bottle means. Thus, the volume of the inner bottle is adjusted so that the formulation, having a specific surface tension, e.g. between 25 and 15 dynes/cm, will not stream through the tip when the inner bottle is inverted. The size of the inner bottle is between about 0.5 ml and 5 ml for perfluorodecalin formulation as hereinabove set forth.

Outer bottle means is provided and disposed around the inner bottle means, for compressing the inner bottle means.

In this configuration, the inner bottle means is isolated from the environment by the outer bottle means which has a distinct advantage in reducing loss of the volatile preservatives, such as chlorobutanol in aqueous formulations. Loss of the fluid, e.g., water, is also reduced which is often a significant problem in warm geographic regions. Hence, the dropwise liquid dispenser system in accordance with the present invention extends the shelf life of the stored liquid formulations.

In addition, the outer bottle means also acts as a barrier to prevent the label components, such as adhesives and dyes, from diffusing into the liquid formulation because separate inner bottle and outer bottle diffusion is prevented, which might otherwise contaminate the liquid formulation. Also the outer bottle may be formed from recyclable plastic which would otherwise be unacceptable for this use. This is important in view of current environmental concerns with regard to waste disposal and conservation of materials and energy.

Another significant feature of the present invention is the size provided and available through the use of the outer bottle means which facilitates the handling thereof, which is particularly advantageous for the infirm and elderly. In addition, the shape of the outer bottle may be configured, e.g, with an oval shape, to aid in handling by the elderly.

More particularly, in the dispensing system according to the present invention, the inner and outer bottle means are sealed together at neck portions thereof, and each of the inner and outer bottle means comprises body portions spaced apart from one another. As hereinabove noted, this significantly reduces, if not totally eliminates, the possibility of diffusion from outside the outer bottle to inside the inner bottle.

Further protection of the liquid formulation may be afforded by forming the inner bottle from a light opaque material and, in the case of liquid formulations which are oxygen sensitive, an inert gas may be provided between the inner and outer bottle means. This is important since many ophthalmic formulations are subject to degradation during storage by either exposure to light or oxygen and, in many cases, interaction of the active agents in the ophthalmic formulation with the container material is detrimental to the activity of the ophthalmic formulation. In this regard, a barrier or liner (e.g., aluminum or resin) may be disposed on an inside wall of the outer bottle to provide protection from light and oxygen.

The outer bottle means, in accordance with the present invention, is configured for providing hydraulic advantage for compressing the inner bottle means with the hydraulic advantage being manifested by the outer bottle means having a greater inner surface area than the outer surface of the inner bottle means.

Further, hydraulic fluid may be disposed between the inner bottle means. In order to ensure pure hydraulic effect, means may be provided for preventing contact between the inner and outer bottle main bodies upon compression of the outer bottle means.

In one embodiment of the present invention, compression of the outer bottle means may be facilitated through the use of accordion-like folds and in yet another embodiment, a diaphragm may be disposed between the inner and outer bottle means for providing pneumatic cushion between the inner bottle means and the outer bottle means.

In another embodiment of the present invention, the inner bottle means may comprise a rigid wall portion and a compressible portion to further enhance and modify the hydraulic effect.

BRIEF DESCRIPTION OF THE DRAWINGS

The advantages and features of the present invention will be better understood by the following description when considered in conjunction with the accompanying drawings in which:

FIG. 1 is an overall perspective view of the dropwise liquid dispensing system in accordance with the present invention, generally showing overall size configuration of an outer bottle;

FIG. 2 is a perspective view of the liquid dispensing system further illustrating the usefulness and size of the bottle which is suitable for easy manipulation by users;

FIG. 3 is a cross-sectional view of one embodiment showing an inner bottle, an outer bottle, and a sealed space therebetween filled with an inert gas or the like;

FIG. 4 is an alternative embodiment of the present invention showing the outer bottle as having accordion-like pleats in the side wall of the outer bottle to facilitate compression thereof;

DETAILED DESCRIPTION

Figure 5:
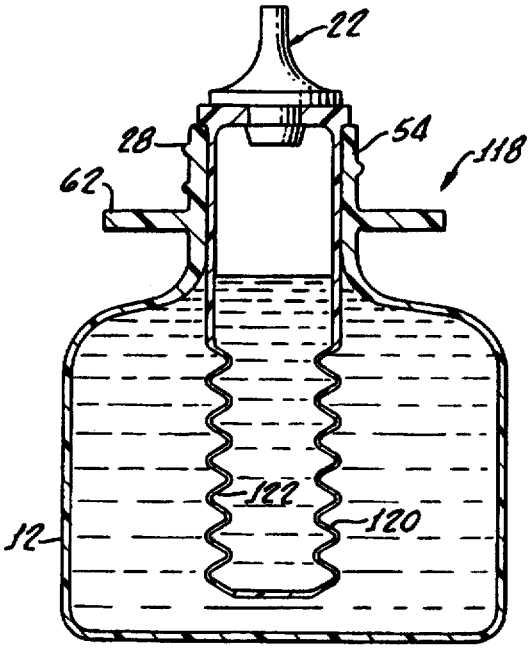
FIG. 5 is another embodiment of the present invention showing accordion-like pleats in the inner bottle to control dispensing thereof.

Turning now to FIG. 1, there is generally shown a dropwise liquid dispensing system 10 in accordance with the present invention, specifically showing an outer bottle 12 sealed by a cap 14. Accordingly, the outer bottle 12 is sized and shaped for facilitating easy handling and compression thereof by a user's fingers 18 in order to dispense in a dropwise fashion a liquid formulation as indicated by a drop 20 from a tip 22.

The size of the outer bottle 12, for example, approximately 10 cc, is sufficient for application of a label 26 having imprinted indicia 28 describing contents and other pertinent information as may be required or suggested by regulatory agencies. This is particularly important in the case of prescribed formulations in order that proper identification of the bottle contents is easily recognized by the user. The cap 14 includes inner screw threads (not shown) for engaging molded threads 28 on the tip 22.

As more clearly set forth in FIG. 3, the liquid dispensing system 10, in accordance with the present invention, generally includes, in addition to the outer bottle 12 and the tip 22, an inner bottle 30 which provides a means for both containing a liquid formulation 32 and for forcing the liquid formulation 32 through the tip 22 upon compression of the inner bottle means to form a drop 20 as illustrated in FIG. 2.

Importantly, the present invention encompasses the liquid formulation 32 particularly for formulations having a low surface tension, i.e., significantly less than water which has a surface tension of about 72.8 dynes/cm @ 20° C.

Preferably, liquids having a surface tension of less than about 40 dynes/cm may be dropwise dispensed with the present invention and specifically a liquid such as a perfluorodecalin formulation may be dropwise dispensed, such formulation having a surface tension of about 18–22 dynes/cm at 25° C., such as for example about 19.3 dynes/cm at 25° C.

Formulations having low surface tensions @ 25° C., suitable for use in the present invention, include, for example, but not limited to:

| Formulation | dynes/cm |
|---|---|
| oleic acid | 32.5 |
| 1-octanol | 26.5 |
| hexane | 18.0 |
| ethyl acetate | 23.97 |
| ethyl alcohol | 22.75 |
| methanol | 22.61 |
| perfluoroheptane | 11.0 |
| perfluoroperhydro-phenanthrene | 21.6 |

It is found that for formulations having a surface tension of 19.3 dynes/cm, the maximum size bottle suitable for providing a dropwise output is approximately 3 ml.

Unfortunately, this size bottle by itself is not compatible with easy handling thereof and compression by a user. Further, because of the limited outer surface area, proper printing of indicia or contents is severely restricted. Consequently, anyone with slightly impaired vision may have difficulty reading the contents of the bottle.

Thus, the volume of the outer bottle 30 provides a means for defining a volume of the inner bottle for preventing the liquid formulation from flowing out of the inner bottle 30 through the tip 20 without compression of the inner bottle. Hence, the problem of liquid formulation streaming out of the tip 22 is solved by using a smaller inner bottle size. In this instance, the vacuum in the small inner bottle 30, as well as the surface-to-volume of the formulation creates a "suck back" vacuum, thus allowing more control with the tip 22. As shown in FIG. 3, the outer bottle 12 is disposed around the inner bottle 30 and provides, as hereinafter described, a means for compressing the inner bottle 30.

Because the outer bottle includes an interior surface and an outer surface 38 of the inner bottle 30, there is provided a hydraulic advantage in compressing the inner bottle 30 by compression of the outer bottle 12, as shown in FIG. 2.

When the volume 40 between the inner bottle 30 and outer bottle 12 is a compressible gas, as shown in FIG. 3, the gas 40 assumes a constant pressure upon compression of the outer bottle wall 42 which exerts a uniform per square inch pressure on all of the exposed surfaces 36, 38. Accordingly, the smaller total pressure is exerted on the inner bottle 30 due to the smaller area of the surface 38.

An aperture 46 of selected diameter through the outer bottle wall 42 provides a means for regulating the pressure applied to the inner bottle 30 by compression of the outer bottle 12. The size of the aperture 46 is, of course, dependent upon the sizes of the inner and outer bottles 30, 12, as well as the physical properties of the formulation 32 and the outer tip 22. Additional factors also include the thickness of the outer bottle wall 42 and inner bottle wall 48 and the material of construction of the bottles.

The inner bottle 30 may be molded separately and thereafter disposed in the outer bottle by either a snap lock o bonded in the neck portions 52, 54 of the inner and outer bottles 30, 12, respectively, in any convenient manner, including spin welding.

While cylindrical inner and outer bottles 30, 12 are shown in the figures, it is to be appreciated that the inner and outer bottles may have the shape of an oval or any other convenient shape which also effects the compressive advantage between the inner and the outer bottles and provides ease of use by the elderly.

Wall thickness of the inner and outer bottles 30, 12 is of importance in the operation of the dispensing system 10. In this regard the wall thickness will, of course, depend not only on the surface tension of the formulation, but on bottle 30, 12 material, size and shape.

It has been found that for a formulation comprising 0–4% drug, 0–5% suspending agent, and the balance perfluorodecalin, the inner bottle 30 should be about 2–5 ml and the outer bottle should be about 7–20 ml with wall thicknesses respectively of between 0.010 inch and 0.050 inch for cylindrical bottles 30, 12, composed of low density polyethylene. Oval bottles are thicker (0.030 inch–0.060 inch) on their sides and thinner on their ends (0.010 inch–0.050 inch).

In addition, if the formulation 32 is a light-sensitive formulation such as levobunolol, dipivefrin, epinephrine, phenylephrine, the inner bottle may be formed of light opaque material. Alternatively, a barrier or liner, 56, such as aluminum or resin, may be disposed on the inside surface, or wall, 36 to provide protection from light and oxygen. Further, for oxygen-sensitive formulations, an inert gas may be provided between the inner and outer bottles 30, 12 with, of course, the aperture 46 eliminated in this embodiment.

Hence, antioxidants—such as potassium metabisulfite, sodium bisulfite, ascorbyl palmitate, butylated hydroxyanisole, butylated hydroxytoluene, ascorbic acid, monothioglycerol propyl gallate, and tocopherol formulations containing antioxidants—are to be eliminated from aqueous solutions such as levobunolol, sulfacetomide, epinephrine and phenylephrine. This is desirable because they are known to be toxic and irritating, and some people are allergic to them.

The inert gas will also eliminate diffusion of $CO_2$ which will form carbonic acid that will lower the pH of a formulation with low buffer strength such as dipivefrin. Suitable inert gases include nitrogen, neon, argon, krypton, xenon and radon, among others.

Another important advantage offered by the present invention is the use of recyclable materials for the outer bottle 12 which hereinbefore could not be utilized because of interaction of such materials with ophthalmic formulations. Since the outer bottle 12 is of greater size the majority of the present invention may be formed from environmentally acceptable materials while limiting the use of expensive materials for the inner bottle 30 contacting the ophthalmic formulations.

The tip 22 may be of any conventional design for the dispensing of drops from a bottle and may be fitted to the inner bottle by a snap fitting. In addition, a rib 62 may be provided in the outer bottle neck 54 for strengthening purposes. Also shown in FIG. 3 is a rigid cylinder 66 which may be disposed around the inner bottle 30 which provides a means for preventing contact between the inner surface 36 of the outer bottle 12 and the outer surface 38 of the inner bottle 30 which may be desired in some instances. A number of perforations 70 may be provided in the cylinder to promote fluid flow.

Turning now to FIG. 4, there is an alternative embodiment 108 of the present invention in which an outer bottle 110 includes accordion-like folds which provide a means for facilitating compression of the outer body 10. In this embodiment, the bottle is compressed from a bottom 114 upwards towards the tip 22 with the rib 54 providing a convenient rib for manual squeezing of the outer bottle 10. With the proper selection of bottle thickness, folds 112 provide an additional means for controlling the relative compression forces between the inner bottle 30 and the outer bottle 110.

It should also be appreciated that because of the dual bottle configuration of the present invention, the outer bottle may be formed of commonly used, inexpensive, plastic materials, while the material of the inner bottle 30 may be of specific composition to prevent reaction with the liquid formulation 32 stored therein, or extraction of components, e.g., plasticizers and antioxidants that would be toxic.

Turning now to FIG. 5, there is shown yet another embodiment 118, in which the inner bottle 120 includes walls 122 with accordion-like folds. This configuration may also be selected for facilitating compression of the inner bottle 120 by the outer bottle 112.

Figure 6:
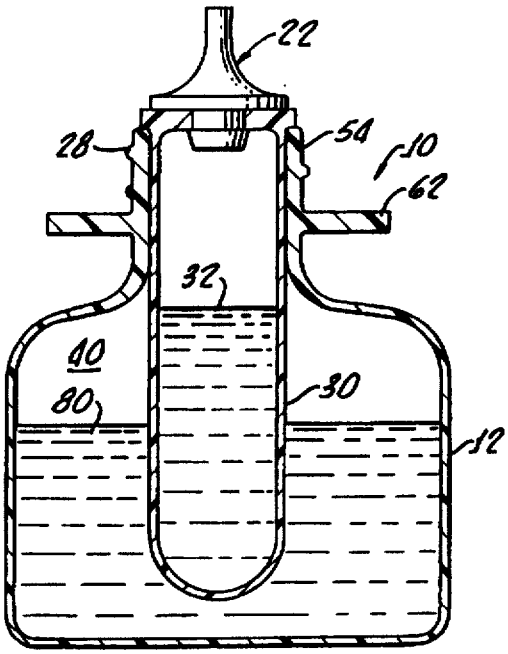
FIG. 6 is a cross-sectional view of another embodiment of the present invention in which the volume between the inner bottle and the outer bottle is partially filled with a fluid.
Figure 7:
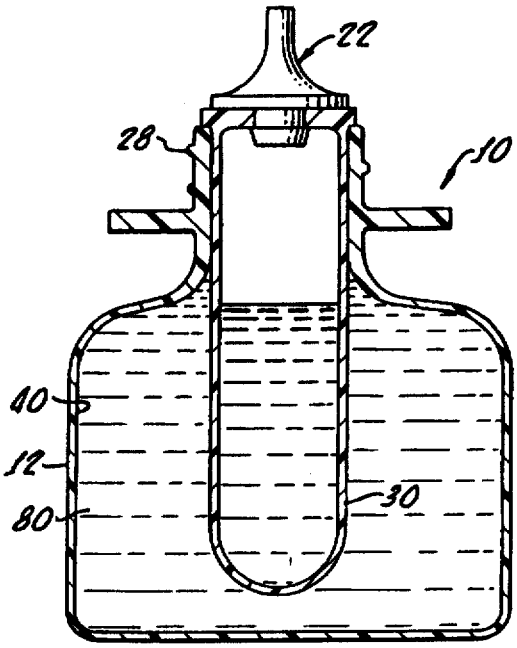
FIG. 7 is a cross-sectional view of yet another embodiment of the present invention in which a volume between the inner bottle and the outer bottle is totally filled with fluid.

As shown in FIGS. 6 and 7 respectively, the dispensing system 10, in accordance with the present invention, may include volume 40 between the inner and outer bottles 30, 12, which may be partially filled with a liquid formulation 80, as shown in FIG. 6, or totally filling a volume 40, as shown in FIG. 7.

Figure 8:
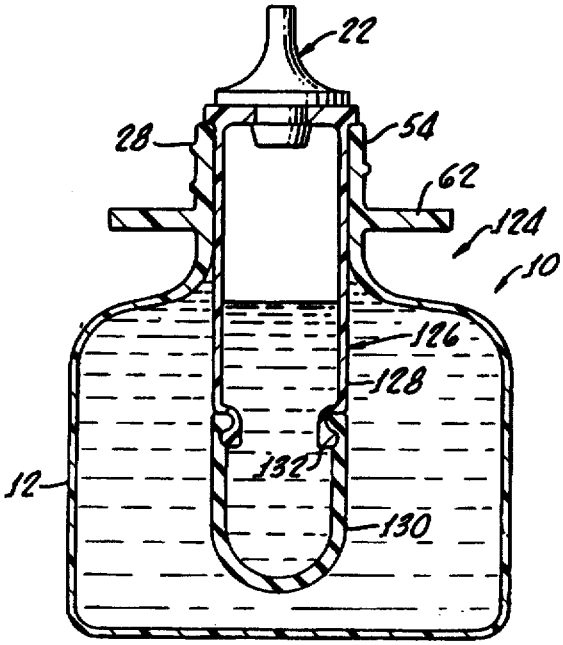
FIG. 8 is a cross-sectional view of still another embodiment of the present invention in which the inner bottle is comprised of a rigid portion and a compressible portion.

In yet another embodiment 124, in accordance with the present invention, as shown in FIG. 8, in which inner bottle 126 comprises a rigid portion 128 with a compressible portion 130 sealed to an end 132 of the rigid portion 128. In this fashion, the inner bottle corresponds to a typical eye dropper which is surrounded by the outer bottle 12.

Although there has been hereinabove described a particular arrangement of a dropwise liquid dispensing system in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the present invention as defined in the appended claims.

What is claimed is:

1. A dropwise liquid dispensing system comprising:

a liquid formulation having a surface tension of less than a specific value;

tip means for dispensing of the liquid formulation in a dropwise fashion;

inner bottle means, in communication with said tip means, for both containing the liquid formulation and forcing the liquid formulation through the tip means upon compression of the inner bottle means;

means, defining a volume of said inner bottle means, for preventing the liquid formulation from flowing out of the inner bottle means through the tip means without compression of the inner bottle means;

means for facilitating compression of the inner bottle means comprising accordion-like folds in the inner bottle means; and outer bottle means, disposed around said inner bottle means, for compressing the inner bottle means.

2. The dispensing system according to claim 1 wherein the specific value of the liquid formulation surface tension is less than about 25 dynes/cm and the inner bottle means volume is less than about 4 ml.

3. The dispensing system according to claim 2 wherein the liquid formulation comprises perfluorodecalin.

4. The dispensing system according to claim 2 wherein the inner and outer bottle means are sealed together at neck portions thereof and each of the inner and outer bottle means comprises body portions spaced apart from one another.

5. The dispensing system according to claim 2 wherein the liquid formulation is light sensitive and the inner bottle means comprises a light opaque material.

6. The dispensing system according to claim 2 wherein the liquid formulation is oxygen sensitive and an inert gas is provided between the inner and outer bottle means bodies.

7. The dispensing system according to claim 2 wherein a volume between the inner and outer bottle means is filled with air and the dispenser further comprises aperture means, disposed in a wall of the outer bottle, for regulating pressure applied to the inner bottle by compression of the outer bottle means.

* * * * *